United States Patent [19]

Williams

[11] Patent Number: 4,841,819

[45] Date of Patent: Jun. 27, 1989

[54] FUSE PULLER

[75] Inventor: Danny L. Williams, Clarinda, Iowa

[73] Assignee: Lisle Corporation, Clarinda, Iowa

[21] Appl. No.: 159,231

[22] Filed: Feb. 23, 1988

[51] Int. Cl.[4] ..... B25B 27/14

[52] U.S. Cl. ..... 81/3.8; 29/278

[58] Field of Search ..... 81/3.8; 29/278, 280; 269/254 R; 294/99.1, 99.2, 100

[56] References Cited

U.S. PATENT DOCUMENTS 3,215,006 11/1965 Urani ..... 81/3.8

4,541,311 9/1985 Trammell, Jr. ..... 29/278 X

OTHER PUBLICATIONS

"Buss Fuse Puller", McGraw-Edison Company, Catalog #BP/FP-C.

*Primary Examiner*—Debra Meislin

*Attorney, Agent, or Firm*—Allegretti & Witcoff, Ltd.

[57] ABSTRACT

A cylindrical and blade fuse puller is disclosed. The puller is made entirely of glass filled nylon and has a one-piece body with two sets of fuse jaws extending outwardly from the body at an angle to one another. A slider slides between the body and a mid-point on one set of arms to force the arms together to clamp the outer periphery of a cylindrical fuse.

4 Claims, 1 Drawing Sheet

FUSE PULLER

BACKGROUND OF THE INVENTION

This invention relates to fuse pullers for installing or pulling fuses. More specifically, this invention relates to fuse pullers having one portion for installing or pulling cylindrical fuses and, alternatively, another end for installing or pulling blade fuses.

A fuse is a type of circuit breaker in an electrical circuit. A fuse 'breaks' the circuit, i.e., stops the flow of electrical current in the circuit, when a level of current flows through the circuit that exceeds the ceiling for current flow allowed by the fuse. In one type of popular fuse, a cylindrical automative fuse for example, a wire in the fuse burns out and breaks the circuit through the fuse when the current exceeds the wire's maximum current flow capacity.

After such a fuse burns out and breaks the circuit, the circuit will not operate until the fuse is replaced. The old fuse must be removed and new fuse installed.

In automotive applications in particular, the fuses are often located in a difficult-to-reach location, such as under the dashboard or in even more remote locations. The fuses are also frequently mounted in parallel, very close together, and in a recessed or semi-recessed area in a small fuse box. The object is to protect the fuses from inadvertent contact with occupants or contaminants (such as water splashing up from the car floor) while allowing access when needed and intended for installation and replacement when necessary.

While this type of mounting does provide essential protection for both the fuses and the occupants, it frequently renders both removal and installation of a fuse a remarkably frustrating task. Frequently, the human hand simply cannot reach into the cramped space between the fuse and the fuse box or between adjacent fuses where not separated by a fuse box wall. In addition, it is dangerous to try to remove the fuses by grasping them with bare hands, since there is always the risk of electrical shock if the hands make contact with the opposing fuse clamps for the fuse.

These same types of concerns with blade-type fuses. Blade fuses usually have a flattened body blade with a protruding ridge on one side of the blade and two prongs extended from the other in the plane of the body.

Several tools exist in the prior art for removing and/or installing one or both of these types of fuses. One tool used to remove the cylindrical fuses is a screwdriver with an insulated handle. The screwdriver blade is inserted into the area of cylindrical fuse to pry it loose from the two clamps retaining it in the fuse box at each end of the fuse. This tool rises breaking the glass intermediate section of the fuse, making further removal of the broken pieces very difficult. It also risks breakage to other fuses in the vicinity of the fuse being removed.

Another prior art tool has a small plastic body with two sets of resilient arms extending in different directions from the body. One set of arms is designed to clamp the periphery of a blade type fuse, and the other the cylindrical periphery of the cylindrical fuse. The arms for the blade fuse grasp the blade securely by grasping the protruding ridge on the side of the blade fuse body opposite the fuse blades. The arms for the cylindrical fuse do not clamp the cylindrical fuse as securely, however, because the cylindrical surface is more difficult to grasp with the level of clamping force provided by the resilient arms alone.

OBJECTS

It is an object of the present invention to provide a simple, inexpensive, and long-lasting tool to safely and securely install and remove cylindrical fuses, especially in the automotive environment.

An additional object is to provide such a tool that also safely and securely installs and removes blade fuses.

A further object is to provide such a tool that provides more secure clamping of a glass body on a cylindrical fuse than can be consistently attained with the clamping tools already existing in the prior art.

A still further object is to provide such a tool for easy grasping and use with one hand and with the hand well separated from the fuse box area and insulated from electrical contact with the fuse or fuse box.

There are other objects and advantages which will become apparent from the discussion below.

SUMMARY OF THE INVENTION

The foregoing and other objects and advantages are attained by the present improved fuse puller. The improved puller includes a body, two resilient jaws extending from the body, and a slider. The jaws are spaced from each other and have opposed arcuate detents for grasping the outer periphery of a cylindrical fuse. The slider slides from the body around the jaws toward the arcuate detents to force the jaws and detents together to grasp the outer periphery of the fuse.

BRIEF DESCRIPTION OF THE DRAWINGS

The preferred embodiment of the present invention is shown in the accompanying drawings wherein.

DESCRIPTION OF THE PREFERRED EMBODIMENT

Figure 1:
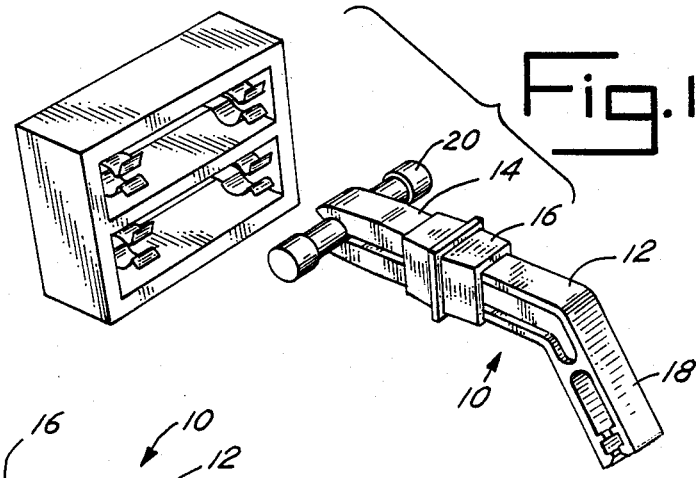
FIG. 1 is a pictorial view of the preferred puller being used to insert a cylindrical fuse into a fuse box.
Figure 2:
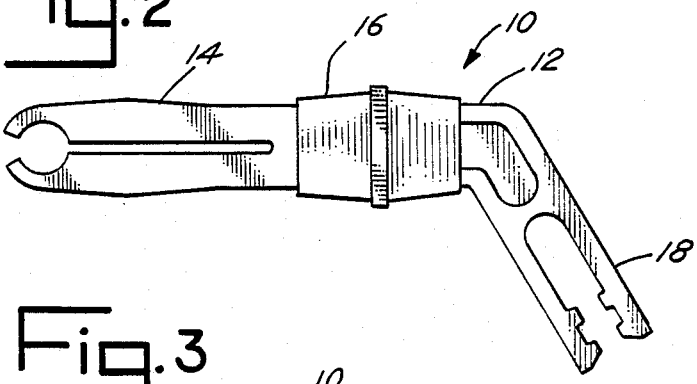
FIG. 2 is a side plan view of the preferred embodiment of the puller.
Figure 3:
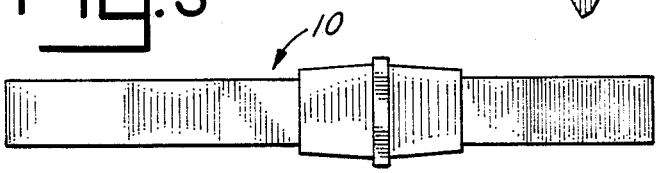
FIG. 3 is an elevational view of the preferred embodiment of the puller.

Referring to FIG. 1, the preferred embodiment, generally 10, has four main components: an insulating body 12, a pair of insulating, resilient cylindrical fuse jaws 14, an insulating slider 16, and a pair of insulating, resilient blade fuse jaws 18. The body 12, cylindrical fuse jaws 14, and blade fuse jaws 18 are made of one molded piece of 13% glass filled nylon. The slider is made of a separate piece of the same material, so the tool provides electrical insulation between a fuse 20 grasped by the jaws 18, 16 and the operator's hands, not shown.

Figure 4:
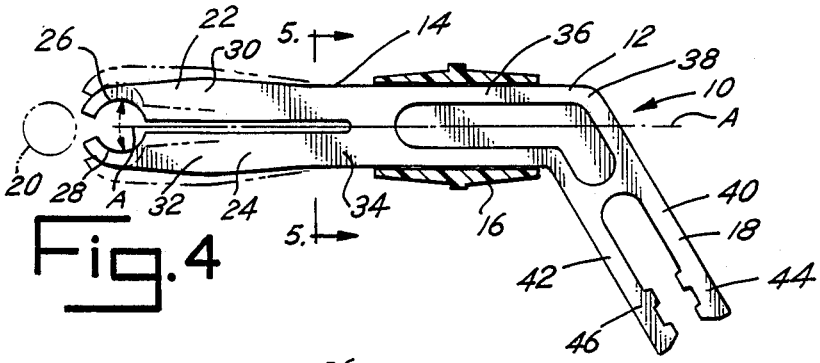
FIG. 4 is a cross-sectional plan view of the tool showing the substantially parallel portion of the jaws when not clamping a cylindrical fuse and, in the phantom lines, the expanded position of the arms when clamping the same fuse.

As shown in FIG. 4, the pair of cylindrical fuse jaws 14 extend from the body 12. The pair 14 consists of an upper jaw or arm 22 parallel with and spaced from the lower jaw or arm 24 when not grasping a fuse. The upper and lower jaws 22, 24 have opposing upper and lower arcuate detents 26, 28, each having an internal arcuate periphery of approximately the same radius of a common cylindrical fuse 20 for use in automative applications. The detents 26, 28 are at the ends of the respective cylindrical fuse jaws 22, 24 opposite the body junction 34 joining the jaws 22, 24 with the body 12.

Each of the cylindrical fuse jaws 22, 24 have respective upper and lower thickened slider stops 30, 32 intermediate their respective detents 26, 28 and the body junction 34. These stops 30, 32 define the area of maximum thickness of their respective cylindrical fuse jaws 22, 24.

The body 12 has a slider rest section 36 intermediate the body junction 34 and an angled slider stop 38. The blade fuse jaws 18 extend from the angled slider stop 38 at a 120% angle to the main axis of the body 12, which is coaxial with a line A passing between and parallel to the opposing cylindrical fuse jaws 22, 24 when in their free, unclamping state.

The pair of blade fuse jaws 18 consist of opposing and parallel upper 40 and lower 42 blade fuse jaws. The blade fuse jaws 40, 42 have two opposing upper 44 and lower 46 blade fuse clamping teeth at their respective ends 48, 50. The opposing blade fuse clamping teeth 44, 46 are adapted to clamp a blade fuse ridge (not shown) on the edge of a typical blade fuse body (not shown) opposite the two metallic fuse blades (not shown) extending from the blade fuse body.

Figure 5:
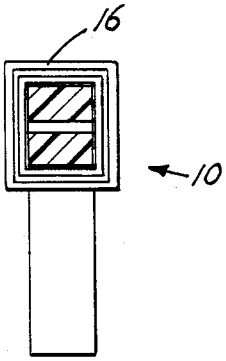
FIG. 5 is a cross-sectional view taken along section line 5—5 of FIG. 4.
Figure 6:
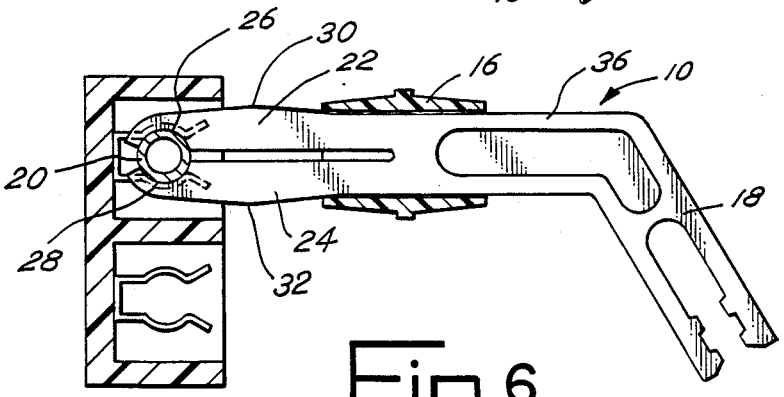
FIG. 6 is a cross-sectional view of the puller with the slider engaging the jaws to clamp the jaws against the outer periphery of a cylindrical fuse in a fuse box.

As shown in FIGS. 1 and 5, the slider 16 is box-like with a four-sided box-like internal periphery. The slider 16 is adapted to slide over (i) the substantially box-like extreme outer periphery of the puller body slider rest section 36 and (ii) onto a portion of the adjoining substantially box-like extreme outer periphery of each of the cylindrical fuse jaws 22, 24.

Thus, as shown in phantom lines in FIG. 4, the resilient cylindrical fuse jaws 22, 24 will bend outwardly to accommodate penetration of a cylindrical fuse 20 between their respective detents 26, 28. As shown in FIG. 5, while grasping the blade fuse jaws 18 the operator can then, with a finger or thumb of the same hand grasping the insulating jaws 18, press the insulating slider 16 from the slider rest section 36 toward the detents 26, 28 on the respective upper and lower insulating cylindrical fuse jaws 22, 24. As the operator presses the slider 16 toward the detents 22, 24, the slider contacts the thickened slider stops 30, 32 which forces the opposing detents 26, 28 to move toward each other to clamp firmly against the outer glass periphery of the fuse 20 without breaking the glass. The slider stops 30, 32 are also sufficiently thick to prevent the slider 16 from sliding off of the ends of cylindrical fuse jaws 22, 24 even when not grasping a fuse 20 no matter how close together the cylindrical fuse jaws 22, 24 are forced by the movement of the slider 16 or otherwise.

Removal of the fuse 20 requires the exact opposite procedure. In this regard, the angled slide stop 38 also prevents the slider 16 from sliding off of the other end of the puller, i.e., the blade fuse jaws 18. The slider 16 simply cannot slide from the slider rest section 36 onto the angled blade fuse jaws 18.

While the blade fuse jaws 18 serve as an operator's handle for removal or installation of cylindrical fuses, the cylindrical fuse jaws 22, 24 correspondingly serve the same function for removal or installation of blade fuses.

The preferred embodiment 10 thus provides a safe, inexpensive, and long-lasting puller for the removal or installation of cylindrical and blade fuses in difficult-to-reach sports, particularly although not exclusively in automotive applications. The improved puller is also small and easy to store even in a shirt pocket or in the glove box in a car. It is operated easily with only one hand and provides the operator with control over the force exerted on the outer periphery of the cylindrical glass fuse body so the operator does not inadvertently break the glass.

The above description is the preferred embodiment of the present invention. It is thus illustrative, not itself restrictive.

What is claimed is:

1. An improved fuse puller of the type usable to install or remove both cylindrical and blade type fuses, the improved puller comprising, in combination:

a. a body;

b. a pair of generally parallel, spaced resilient cylindrical type fuse jaws extending from one end of the body, said jaws terminating with cylindrical type fuse jaw ends, each cylindrical type fuse jaw end having an arcuate detent, said pair of arcuate detents being opposed and together defining an at least partially circular shaped gripping member for cooperation with a cylindrical fuse;

c. a pair of generally parallel, spaced resilient blade type fuse jaws extending from the other end of the body, said blade type fuse jaws terminating with blade fuse jaw ends, each blade type fuse jaw end having opposed pairs of blade clamp teeth, each said pair of blade clamp teeth comprising equally spaced teeth which are generally parallel and extend transversely from the blade fuse jaw end toward the other pair of teeth thereby defining an at least a partially rectangular shaped gripping jaw member for cooperation with a blade fuse; and d. a slider mounted on the body and adapted to slide over both cylindrical type fuse jaws toward the opposing arcuate detents in the cylindrical type fuse jaws, to thereby force the resilient cylindrical fuse type jaws together so that the opposing arcuate detents can clamp the outer periphery of a cylindrical fuse;

e. said blade type fuse jaws comprising elastic members retained by elastic force about a blade fuse for removal or insertion of a blade fuse; and f. one of said cylindrical type or blade type fuse jaws serving as a manual gripping member while the other of said fuse jaws completely engages with a compatible fuse.

2. The improved fuse puller of claim 1 wherein at least one cylindrical type fuse jaw has a sloped surface intermediate the detent end of the cylindrical fuse jaw and the body, whereby the slider engages the sloped surface upon movement of the slider toward the cylindrical type fuse jaw ends thereby forcing the opposing arcuate detents toward each other to make intimate contact with a cylindrical fuse.

3. The improved fuse puller of claim 1 wherein the longitudinal direction of the cylindrical fuse jaws is oriented with respect to the longitudinal direction of the blade fuse jaws to define an angle about 120 degrees, thereby defining a manual gripping handle with one of the pairs of jaws.

4. The improved fuse puller of claim 1 including means to increasingly displace the cylindrical fuse jaws toward each other as the slider is displaced toward the detent ends of the jaws.

* * * * *